US012734432B1

(12) United States Patent
Gustin

(10) Patent No.: US 12,734,432 B1
(45) Date of Patent: Sep. 15, 2026

(54) ROULETTE BALL ROUTER WITH BALL RELEASING CHAMBER

(71) Applicant: Bostjan Gustin, Sezana (SI)

(72) Inventor: Bostjan Gustin, Sezana (SI)

(73) Assignee: Winsys IP Holdings, LLC, Miami, FL (US)

( * ) Notice: Subject to any disclaimer, the term of this patent is extended or adjusted under 35 U.S.C. 154(b) by 1110 days.

(21) Appl. No.: 17/737,661

(22) Filed: May 5, 2022

(51) Int. Cl.
*A63F 5/00* (2006.01)

(52) U.S. Cl.
CPC ..... *A63F 5/0005* (2013.01)

(58) Field of Classification Search
CPC .... A63F 5/0005; A63F 5/0023; A63F 5/0029; A63F 5/0035; A63F 5/0088; A63F 5/0076; A63F 5/0082
USPC ..... 273/142 E, 142 R, 143 R, 142 A, 142 D, 273/142 F, 142 G
See application file for complete search history.

(56) References Cited

U.S. PATENT DOCUMENTS 4,601,470 A 7/1986 Kadota et al.
4,735,416 A * 4/1988 McNally ..... A63F 5/0005 273/125 A
7,674,172 B2 * 3/2010 Miltenberger ..... A63F 5/007 273/142 E
8,282,100 B2 10/2012 Kido
8,899,586 B2 12/2014 Shelburn et al.
9,327,186 B1 * 5/2016 Pececnik ..... A63F 5/0088
10,076,701 B2 9/2018 Mercer et al.
10,105,591 B2 10/2018 Mercer et al.
10,504,321 B2 * 12/2019 Burgstaller ..... A63F 5/0076
10,537,786 B2 * 1/2020 Azuma ..... G07F 17/329
10,546,457 B2 1/2020 Snow et al.
10,706,668 B2 * 7/2020 Burgstaller ..... G07F 17/3288
11,731,036 B2 * 8/2023 Kulhanek ..... G07F 17/3202 463/17
2022/0184486 A1 * 6/2022 Bergant ..... A63F 5/007
2023/0338823 A1 * 10/2023 Bergant ..... A63F 5/0088

FOREIGN PATENT DOCUMENTS

WO WO2004094013 A1 11/2004
WO WO2015114302 A1 8/2015

* cited by examiner

*Primary Examiner* — Joseph B Baldori
(74) *Attorney, Agent, or Firm* — Newman Law, LLC

(57) ABSTRACT

An automated roulette apparatus including a roulette wheel mounted for rotational motion on a wheel base, comprising a ball router having a conduit defined in an inner housing, the inner housing being mounted for rotational motion within an outer housing, the outer housing including a first outlet and a second outlet, the inner housing being configured to rotate to a first position aligning the conduit with the first outlet and a second position aligning the conduit with the second outlet, wherein the inner housing includes an inner chamber with a door configured to open to enable access between the inner chamber and the conduit and close to restrict access between the inner chamber and the conduit, and a controller for directing the rotational motion of the inner housing and actuating the door to open and close responsive to a triggering event.

20 Claims, 7 Drawing Sheets

ROULETTE BALL ROUTER WITH BALL RELEASING CHAMBER

BACKGROUND OF THE INVENTION

The invention is directed to wagering games, and more particularly, wheel games typically found in gaming establishments, such as those involving a roulette wheel and virtual representations thereof.

Casinos generally offer a variety of games. Some of these games incorporate or rely on apparatus for randomly determining an outcome, such as for example, games which rely on a wheel mounted for rotational motion, whether mechanically-rotated or manually rotated by a dealer. Wheel games may include wheels mounted for rotational motion such as the Big Wheel and the Big Six, but the most popular of the wheel games is roulette.

Roulette is a well-known casino game which has been played for many years. A typical roulette game consists of a table with betting layout adjacent to a roulette wheel rotor or ring mounted for rotational motion within a support structure. The ring includes a circular array of numbered segments bearing numbers 1 through 36 defined on its upper surface. American Roulette wheels typically have rings which also include the numbers 0 and 00 disposed at diametrically opposite locations on the upper surface, whereas European Roulette wheels include only the number 0. The numbers 1 through 36 are not disposed in numerical order, but rather are typically disposed in a predetermined arrangement, such that roulette wheels located in different casinos will have the same standard predetermined number ring arrangement. The numbers disposed in a circular array in the number ring region of the wheel bear the alternating colors of red and black, with the exception of the 0 and/or 00 numbers, which are typically colored green. A ring of pockets corresponding in number to the plurality of numbers of the ring lies adjacent, but radially inward of the ring, on the typical roulette wheel. A typical roulette wheel further includes a circular, inclined ball track radially outward of the ring.

In operation of a typical roulette game, players place chips or tokens on a betting layout located on a roulette table, and then the croupier or dealer spins the roulette wheel and the roulette ball is placed in motion along the circular ball track in the opposite direction of the rotation of the wheel. As the wheel slows, the ball moves radially inward and comes to rest in one of the pockets associated with a particular one of the numbers of the number ring. After the ball comes to rest in one of the pockets, the croupier or dealer settles the various wagers placed on the table layout in accordance with predetermined rules and wager odds and the process is repeated.

Roulette has remained basically unchanged since its inception in the $18^{th}$ century. Despite the maturity of roulette, the game remains popular in casinos throughout the world. Nonetheless, there is always a need to add excitement to current casino games to increase their popularity with players and increase traffic and wagering at casinos. Naturally, casino operators seek to provide the most popular games for their gaming patrons.

Thus, there is a need for systems and methods which resolve one or more of the problems identified above, among other things.

SUMMARY OF THE INVENTION

The invention is generally directed to a system and method for providing a wheel game apparatus with a multidirectional roulette ball router with a second roulette ball releasable from a hidden chamber which increases the efficiency of operation while also enabling exciting new game play activity.

Some embodiments of the invention are directed to an automated roulette apparatus, the roulette apparatus including a roulette wheel mounted for rotational motion on a wheel base, the roulette wheel including a central cone and a plurality of pockets, the roulette apparatus comprising: a ball router, the ball router having a conduit defined in an inner housing, the inner housing being mounted for rotational motion within an outer housing, the outer housing including a first outlet and a second outlet, the inner housing being configured to rotate to a first position aligning the conduit with the first outlet and a second position aligning the conduit with the second outlet, wherein the inner housing includes an inner chamber with a door configured to open to enable access between the inner chamber and the conduit and close to restrict access between the inner chamber and the conduit; and a controller for directing the rotational motion of the inner housing and actuating the door to open and close responsive to a triggering event.

In some embodiments, a roulette apparatus of the invention further comprises an apparatus for elevating the central cone from a seated position to an elevated position relative to the roulette wheel, wherein the elevated position of the central cone exposes a receiving space.

In some embodiments, the receiving space further comprises a chute connected with the conduit.

In some embodiments, the first outlet is connected with a first ball propelling device. The first ball propelling device may be configured to propel a roulette ball through a tube, the tube having an outlet for directing the roulette ball in a first direction relative to the roulette wheel.

In some embodiments, the second outlet is connected with a second ball propelling device. The second ball propelling device may be configured to propel a roulette ball through a tube, the tube having an outlet for directing the roulette ball in a second direction relative to the roulette wheel, wherein the first and second directions are opposing one another.

In some embodiments, the triggering event is a randomly generated outcome. In some embodiments, the randomly generated outcome is an outcome in a roulette game. In other embodiments, the randomly generated outcome is derived from a random number generator.

In some embodiments, a roulette ball is stored in the inner chamber, the roulette ball being released responsive to the door opening to enable access between the inner chamber and the conduit.

In some embodiments, the central cone further comprises a plurality of illumination devices, each illumination device of the plurality being mounted on a radially outer portion of the central cone.

Some embodiments of the invention are also directed to an automated roulette apparatus, the roulette apparatus including a roulette wheel mounted for rotational motion on a wheel base, the roulette wheel including a central cone and a plurality of pockets, the roulette apparatus comprising: a ball router, the ball router having a conduit defined in an inner housing, the inner housing being mounted for rotational motion within an outer housing, the outer housing including a first outlet, the inner housing being configured to rotate to a first position aligning the conduit with the first outlet, wherein the inner housing includes an inner chamber with a door configured to open to enable access between the inner chamber and the conduit and close to restrict access between the inner chamber and the conduit; a motor configured to elevate the central cone from a seated position to an elevated position relative to the roulette wheel, wherein the elevated position of the central cone exposes a chute connected with the conduit; a controller for directing the rotational motion of the inner housing and actuating the door to open and close responsive to a triggering event; and a first ball propelling device comprising an air blower connected to the first outlet, wherein the first ball propelling device is configured to propel a roulette ball through a tube, the tube having an outlet for directing the roulette ball in a first direction relative to the roulette wheel.

In some embodiments of the aforementioned apparatus the outer housing further includes a second outlet, wherein the inner housing is further configured to rotate to a second position aligning the conduit with the second outlet, the second outlet being connected with a second ball propelling device, the second ball propelling device comprising an air blower. The second ball propelling device may be configured to propel a roulette ball through a tube, the tube having an outlet for directing the roulette ball in a second direction relative to the roulette wheel, wherein the first and second directions are opposing one another.

DETAILED DESCRIPTION OF THE INVENTION

Figure 1:
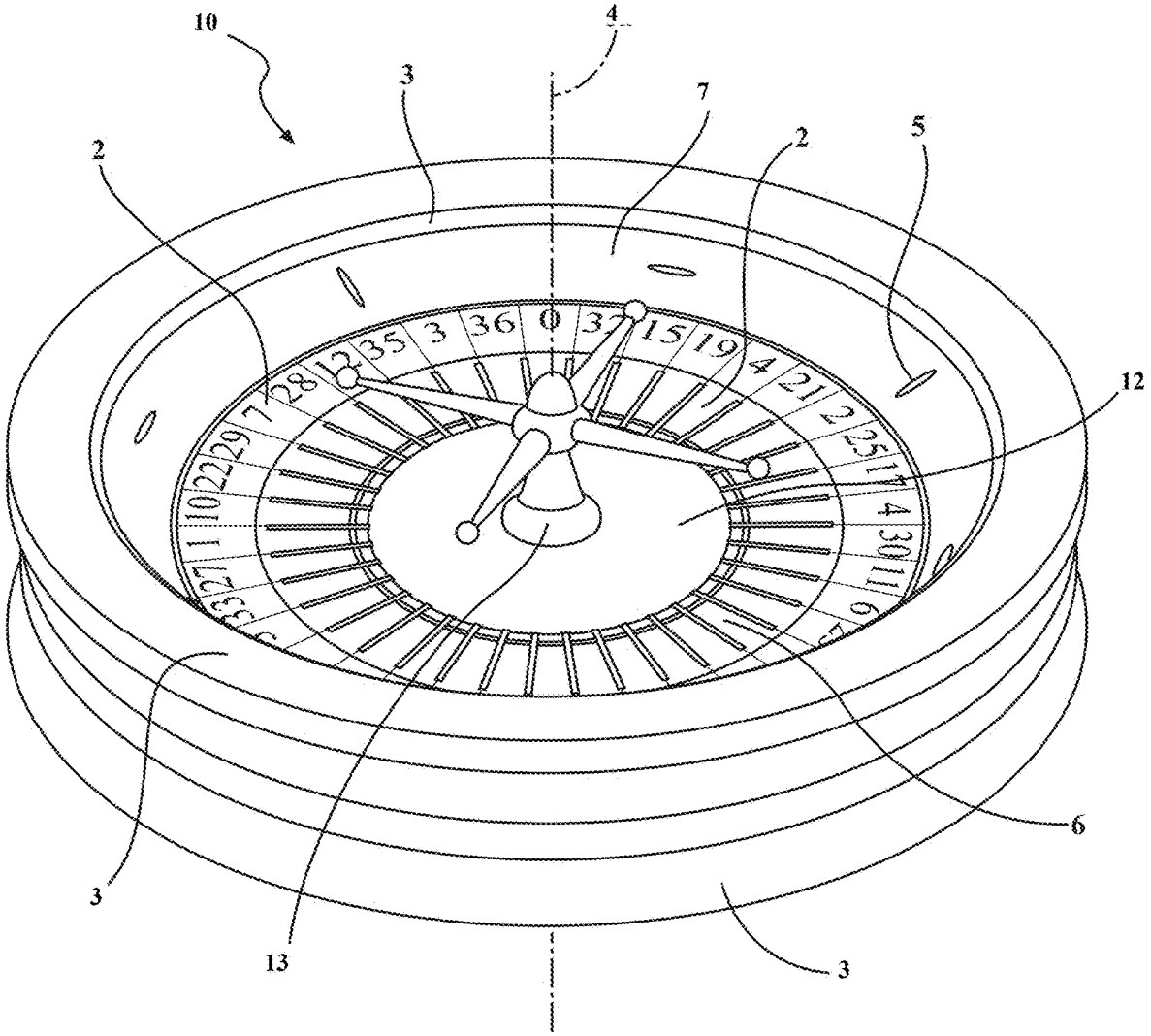
FIG. 1 is a perspective view of a roulette wheel apparatus of the invention.

In the following detailed description, reference is made to the accompanying drawings which form a part of this application. The drawings provide and illustrate specific exemplary embodiments in which the invention may be practiced. It is to be understood that other embodiments may be utilized and structural changes may be made without departing from the scope of the invention. For example, while embodiments of the invention are discussed herein in combination with the game of roulette, it should be readily apparent that the system may be employed with other wheel-based games other than roulette which include a ball.

Selected exemplary embodiments of the invention will now be explained with reference to the drawings. It will be apparent to those skilled in the art from this disclosure that the following description of exemplary embodiments of the invention is provided for illustration only and not for the purpose of limiting the invention.

In some embodiments, the invention involves a roulette wheel mounted for rotational motion, having a plurality of slots defined by side walls and a bottom surface or landing. The rotational motion of the wheel may be hand or mechanically driven by a driving mechanism. If the roulette wheel is motorized, then after expiration of a time period for all wagers to be placed, the game may automatically begin, such as by decreasing or increasing the rotational speed of the wheel. The exemplary embodiments discussed herein generally relate to such electromechanical roulette systems, however, the same, similar or other features of the invention may also be employed in hand operated roulette wheel apparatus.

An exemplary roulette wheel apparatus for use with the invention is generally identified by the reference numeral 10 in FIG. 1-7. Wheel apparatus 10 includes a conventional "American-style" roulette wheel 2 (or "rotor") supported on a wheel base 3 (or "stator") by one or more bearings so that roulette wheel 2 may be rotated relative to the wheel base 3 about a substantially vertical axis of rotation 4.

In the case of an electromechanical roulette wheel, such as the wheel described herein, a drive motor may also be mounted on the wheel base 3 and configured to cause the rotational motion of roulette wheel 2 in one or more speeds in either direction relative to wheel base 3. In some embodiments the drive motor may be an AC electric motor, or low voltage DC electric motor, a stepper motor, or a compressed air motor.

Wheel 2 includes circumferentially positioned equally sized pockets 6 formed by pocket dividers creating a space for a ball to fall therein. Each pocket 6 has a length extending in a radially outer direction relative to the axis of rotation 4 of roulette wheel 2 and a width extending circumferentially relative to the axis of rotation 4 of the roulette wheel 2.

To play roulette, wheel 2 is spun in a selected direction at a selected speed, either by the drive motor or a croupier, and then a ball is propelled in the opposite direction of the spinning wheel 2, generally circling in an upper ball track 7 located at a radially outer position relative to pockets 6. Upper ball track 7 is sloped toward the center of wheel 2 so that as the ball decelerates in the upper ball track 7, gravity will cause the ball to be directed towards pockets 6. Rigidly mounted on wheel 2 are horizontal and vertical ball deflectors 5 designed to disrupt the smooth path of the ball and add a random variable to the path of the ball. As the ball continues to slow, gravity causes it to move toward pockets 6. Eventually the ball will fall into a pocket 6 and be retained or otherwise come to rest within the pocket without further movement on its own. The winning number is the number associated with that pocket based on the corresponding color and number disposed circumferentially in the number ring on the radially outer portion of wheel 2.

Figure 2:
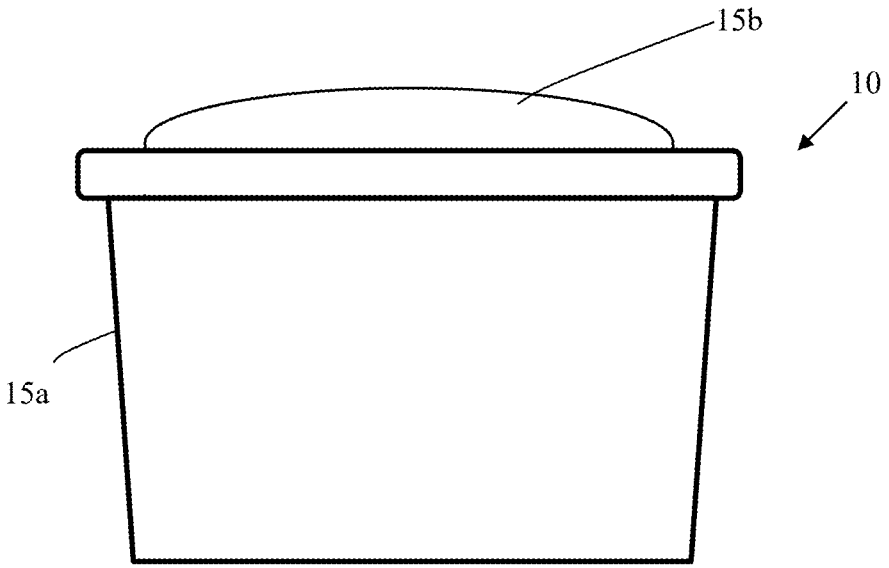
FIG. 2 is side schematic view of an exemplary housing for a roulette apparatus of FIG. 1 constructed in accordance with some embodiments of the invention.
Figure 3:
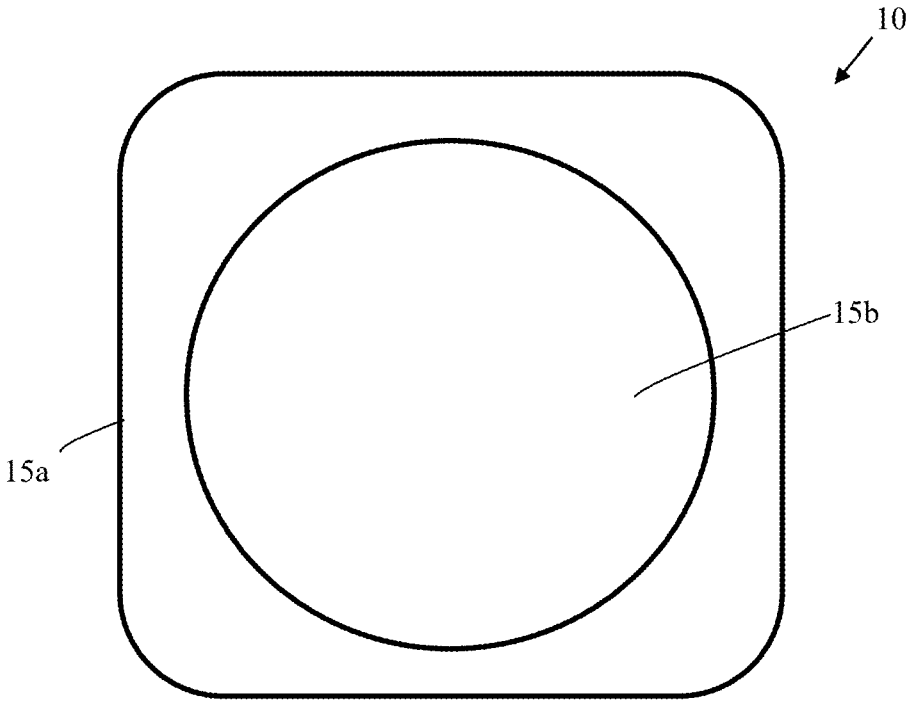
FIG. 3 is a top view of the exemplary housing for the roulette apparatus of FIG. 2.
Figure 4:
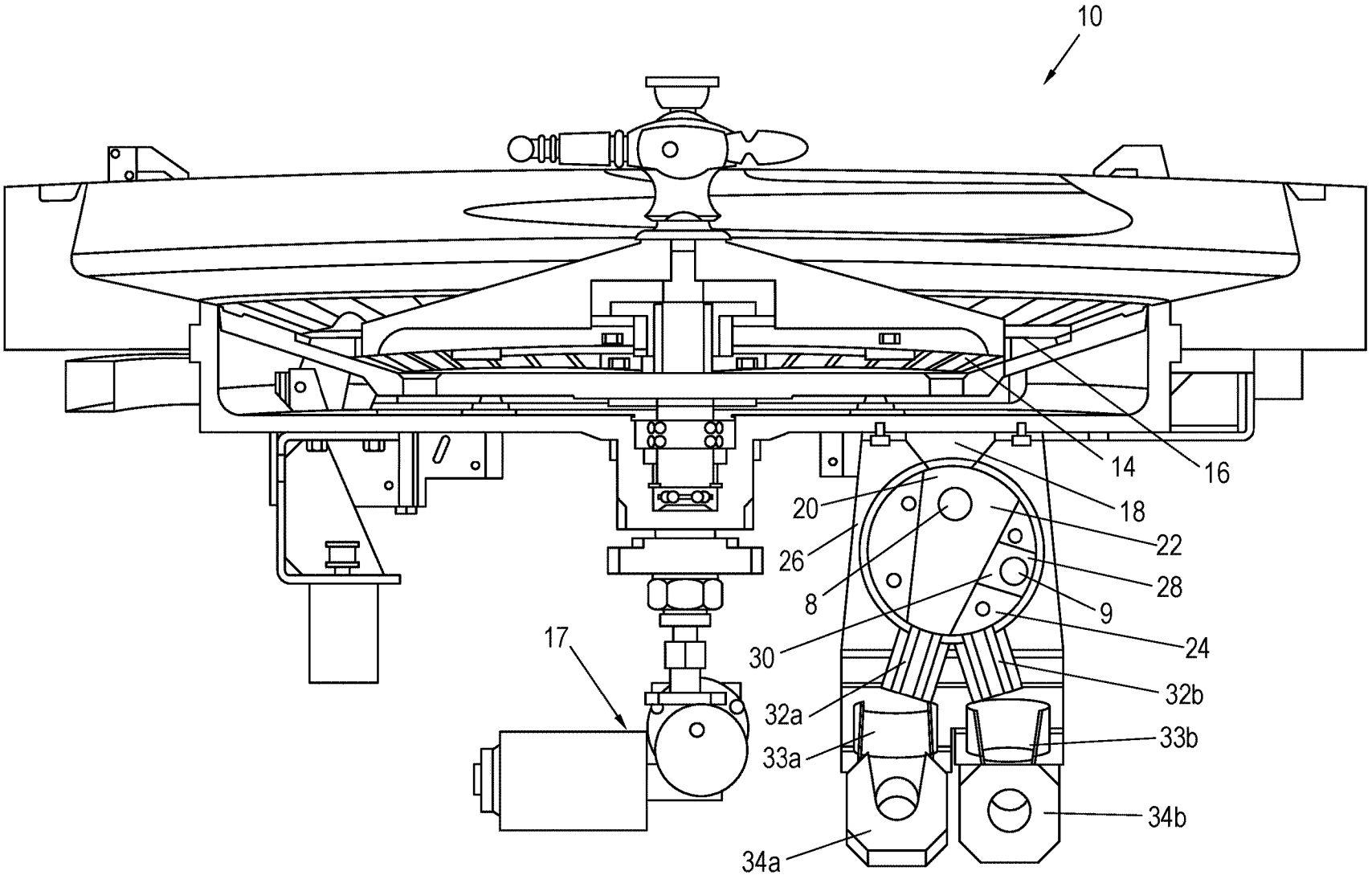
FIG. 4 is cross-sectional side view of roulette apparatus of FIG. 1.
Figure 5:
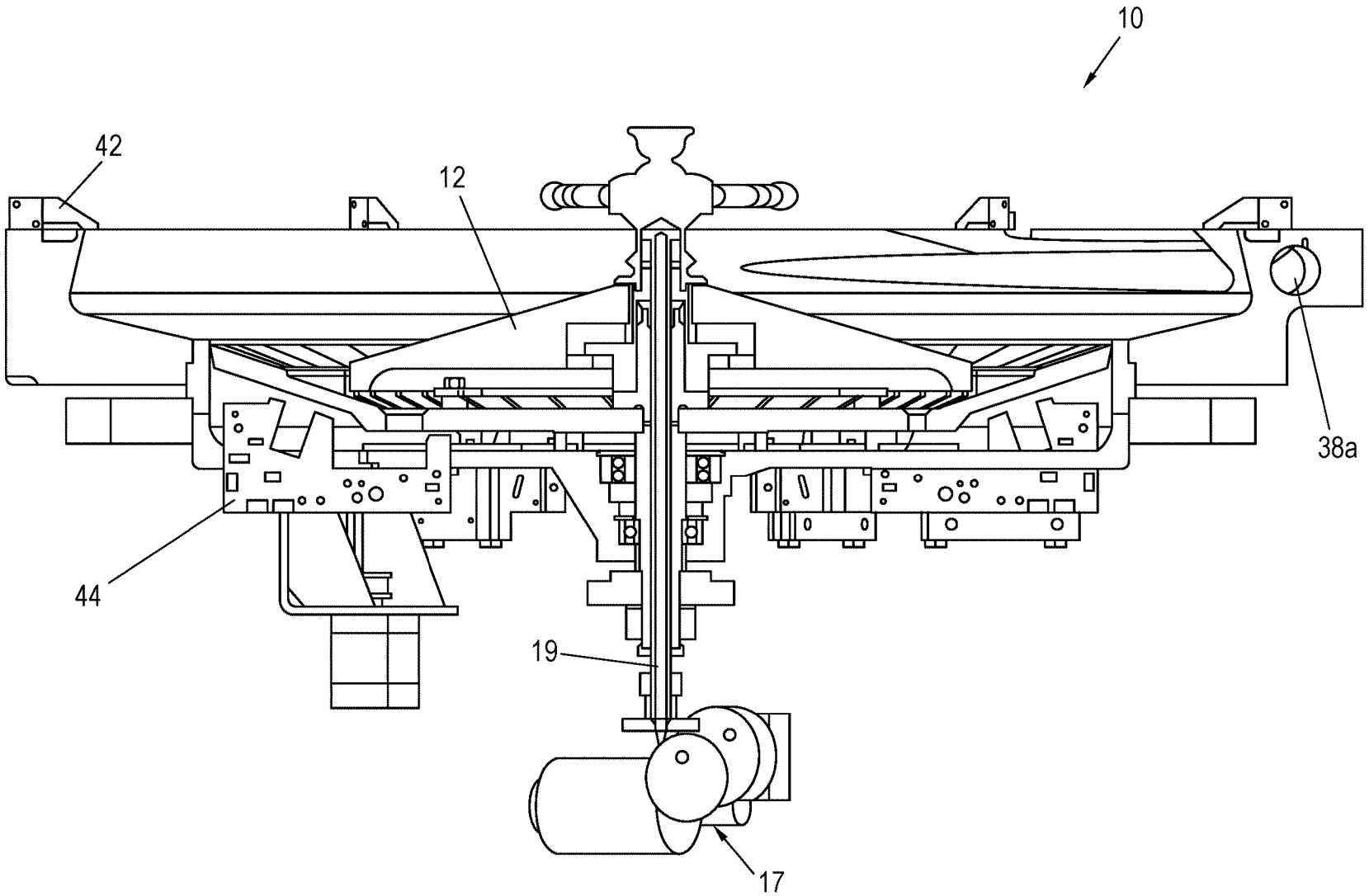
FIG. 5 is another cross-sectional side view of roulette apparatus of FIG. 1.
Figure 6:
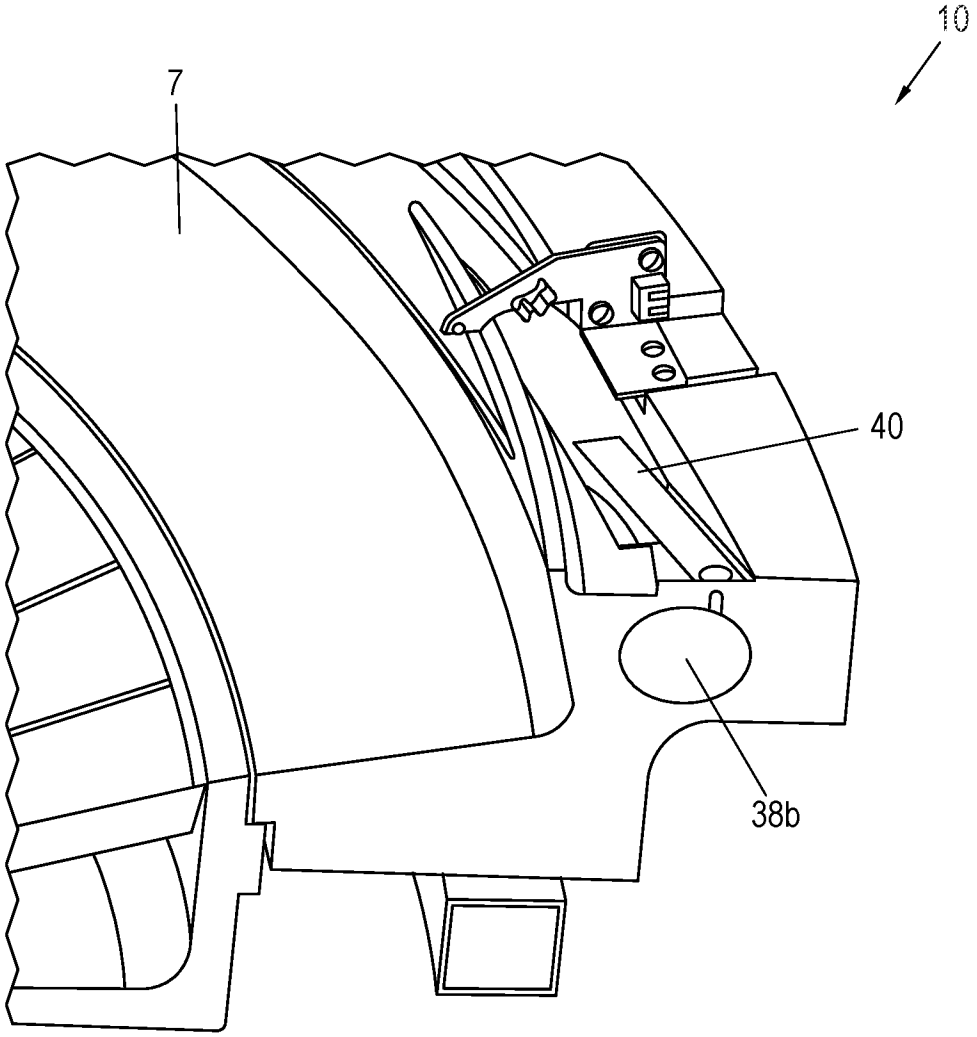
FIG. 6 is a partial cross-sectional side view of the roulette apparatus of FIG. 1.
Figure 7:
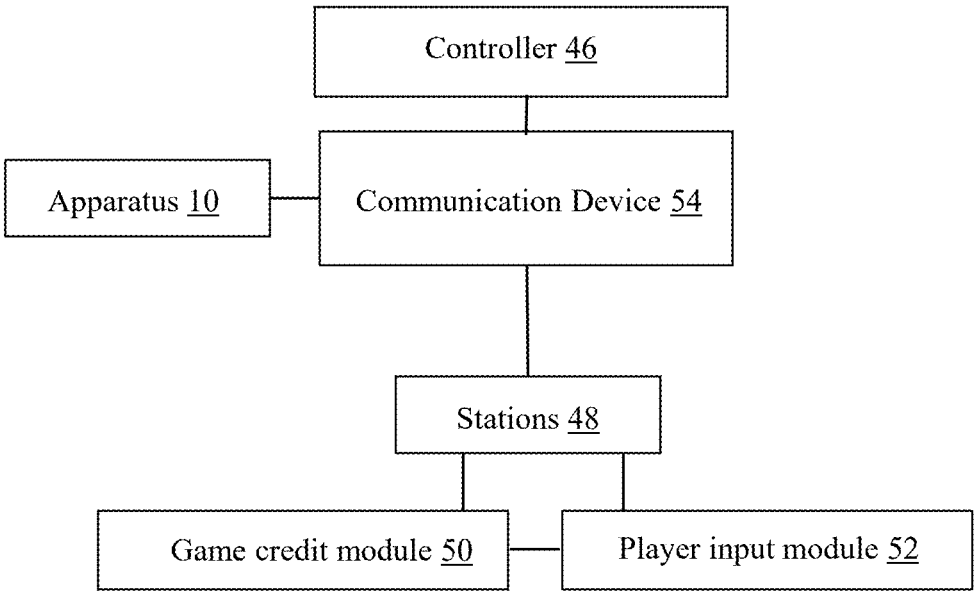
FIG. 7 is a schematic view of a game controller that may be used with the roulette apparatus of FIG. 1.

Apparatus 10 is typically mounted on a table or cabinet so that the bottom thereof is not visible or readily accessible to users. FIGS. 2 and 3 are side and top views, respectively, illustrating apparatus 10 mounted in a housing or cabinet 15*a* that incorporates all the elements necessary for the function of the electromechanical roulette, including computer hardware and software as well as ball sensors, motors and related mechanical components for causing the rotation of wheel 2 and determining the pocket in which the roulette ball lands. Additional elements may be in communication with the system by way of access ports and wireless communication accessible through the cabinet 15*a*. Each cabinet 15*a* includes a service door in order to access the internal components of apparatus 10. Also, a dome enclosure 15*b* may be seated over the roulette wheel apparatus 10.

In this embodiment, roulette wheel apparatus 10 includes an elevating central cone assembly 12 including a turret 13 configured to move between one or more positions alternately concealing and exposing a roulette ball receiving space 14 for receiving a roulette ball therein. Space 14 may be configured to include a circular track 16 which is sloped to influence a roulette ball into the inlet of a chute 18. In this embodiment, a motor 17 is connected with rod 19 for causing the rotational motion of wheel 2 in both counter and a clockwise directions at varying speed. Motor 17 is also configured to use rod 19 to raise and lower central cone 12

Chute 18 outlets into an inlet port 20 of a conduit 22 of an inner housing 24 mounted for rotational motion in an outer housing 26. Inner housing 24 further includes an inner chamber 28 connected with conduit 22 by a door 30. Door 30 is electronically controlled to alternately open and shut upon demand, thereby opening and closing access between chamber 28 and conduit 22.

Outer housing 26 includes two openings 32*a* and 32*b* which are connected with or otherwise feed into chutes 33*a* and 33*b* to ball propelling devices 34*a* and 34*b*, respectively. In some embodiments, ball propelling devices 34*a* and 34*b* comprise air blowers. An exemplary ball travel path is shown on the drawing by the reference number 36 as the ball 8 travels through chute 18, inlet port 20, conduit 22 and ball propelling device 34*a*. In this embodiment, a second ball 9 is within chamber 28. Ball propelling devices 34*a* and 34*b* cause one or both ball 8 and ball 9 to be propelled through tube 38*a* or 38*b*, respectively, upon the opening of door 30.

Tubes 38*a* and 38*b* direct ball 8 and/or ball 9 to be propelled in opposing directions, that is, one directs a ball in a clockwise direction and the other directs the ball counterclockwise along circular track 16. In operation, ball 8 may be directed in through opening 32*a* to be propelled by device 34*a* in a first or clockwise direction, and thereafter, inner housing 24 may rotate such that ball 9 may be directed through opening 32*b* and propelled by device 34*b* in the opposite or counterclockwise direction, or vice versa. Each tube 38*a* and 38*b* may include a bar 40 which prevents the ball from returning through tube 38*a* or 38*b*.

In operation sensor 42 detects the speed and direction of ball 8 and/or ball 9 in apparatus 10. Sensor 44 detects the position of ball 8 and/or ball 9 in a pocket 6 and communicates a signal identifying the pocket to a controller 46. Controller 46 uses the signal to determine when ball 8 and/or ball 9 has come to rest at least for purposes of determining the outcome of various bets which are based on which of the pockets 6 that ball 8 and/or ball 9 lands and is finally retained in.

Then, after the pocket 6 in which the ball 8 and/or ball 9 is retained has been determined, central cone assembly 12 elevates to expose roulette ball receiving space 14 and ball 8 and/or ball 9 travels into circular track 16 and into chute 18 under the influence of gravity. Ball 8 and/or ball 9 may be received in inner chamber 24 which can be rotated to restrict access through openings 32*a* and 32*b* through conduit 22.

Sensor 42 and 44 may be one or a plurality of sensors mounted on the radially inner and/or radially outer portion of a stator associated with the roulette wheel or other component within the wheel or stationary bowl. The sensors may be configured for detecting the presence of the roulette ball therein (or lack thereof). For example, the sensors may be capable of detecting ambient light within the pocket and the change in the ambient light occurring upon the roulette ball entering and/or coming to rest in the pocket. Additional sensors may be mounted on the wheel ring to detect when the roulette wheel is spinning and/or when the ball is placed into motion along the circular ball track.

Ball 8 or ball 9 may be received in chamber 28 through opening door 30 and door 30 may be closed to retain the ball inside chamber 28. Chamber 28 may include a sensor in communication with controller 46 for detecting the presence of ball 8 or ball 9 therein closing door 30. The remaining ball may remain in conduit 22 until inner chamber 24 is rotated to connect conduit 22 with one of openings 32*a* and 32*b*.

In some embodiments the roulette wheel assembly 10 of the invention may be incorporated into an automatic roulette system together with betting apparatus to automatically receive bets placed by users, means to identify winning bets among the placed bets, and payment apparatus allowing users to be paid any winnings. In some embodiments the betting apparatus and payment apparatus may allow users to place bets and be paid any winnings remotely, for example over a communications network such as the Internet. In such embodiments allowing remote betting and payment the automatic roulette system may also comprise one or more cameras to allow remote users to view the roulette wheel assembly 10.

In such embodiments controller 46 may further comprise means for communication with other parts of the automatic roulette system. Controller 46 may include one or more servers, programs, databases, memory, data storage devices, data communication devices and data processing devices. Controller 46 may also be in communication with a random number generator for randomly determining to open door 30 thus releasing ball 9 as a bonus game ball for determining a bonus award, multiplier or other game result. In other embodiments, door 30 is opened responsive to a triggering event in the roulette game.

Controller 46 in this embodiment is generally configured to manage the operation of the roulette apparatus 10 and wagering games relating thereto by receiving wagers placed through player positions or game stations 48 which may be adjacent to apparatus 10 or located remotely. All or some of the components of controller 46, such as a processor and memory containing executable code, may reside together, such as in a game housing, or be variously integrated into other components of apparatus 10. Controller 46 may also include a security code secured keypad and or touchscreen device for use by authorized personnel. Controller 46 includes or is in communication with a card, payment, card, ticket reading or other credit receiving devices as part of module 50 and a player input module 52. In this embodiment modules 50 and 52 are included in each game station 48. Credit module 50 cooperates with player input module 52 which may comprise a button panel or touchscreen mounted at the station 48 to manage the amount of player's credits available for use with apparatus 10. Player input module may also convert currency or a ticket received through credit module 50 in station 48 to credit for use with a game having an outcome determined by roulette apparatus 10. Controller 46 actuates apparatus 10 to generate roulette results, determines the outcome of wagers placed through player input module 52, and awards or increases credits maintained at station 48 if a wager is won. Communication device 54 maintains communication between the gaming apparatus 10 and controller 46.

In such embodiments controller 46 may provide signals to the betting apparatus indicating, or based upon, the timing of the launching of a roulette ball 8 and/or ball 9. The betting apparatus may use these signals to determine when to stop taking new bets on a game of roulette from users.

Figure 8:
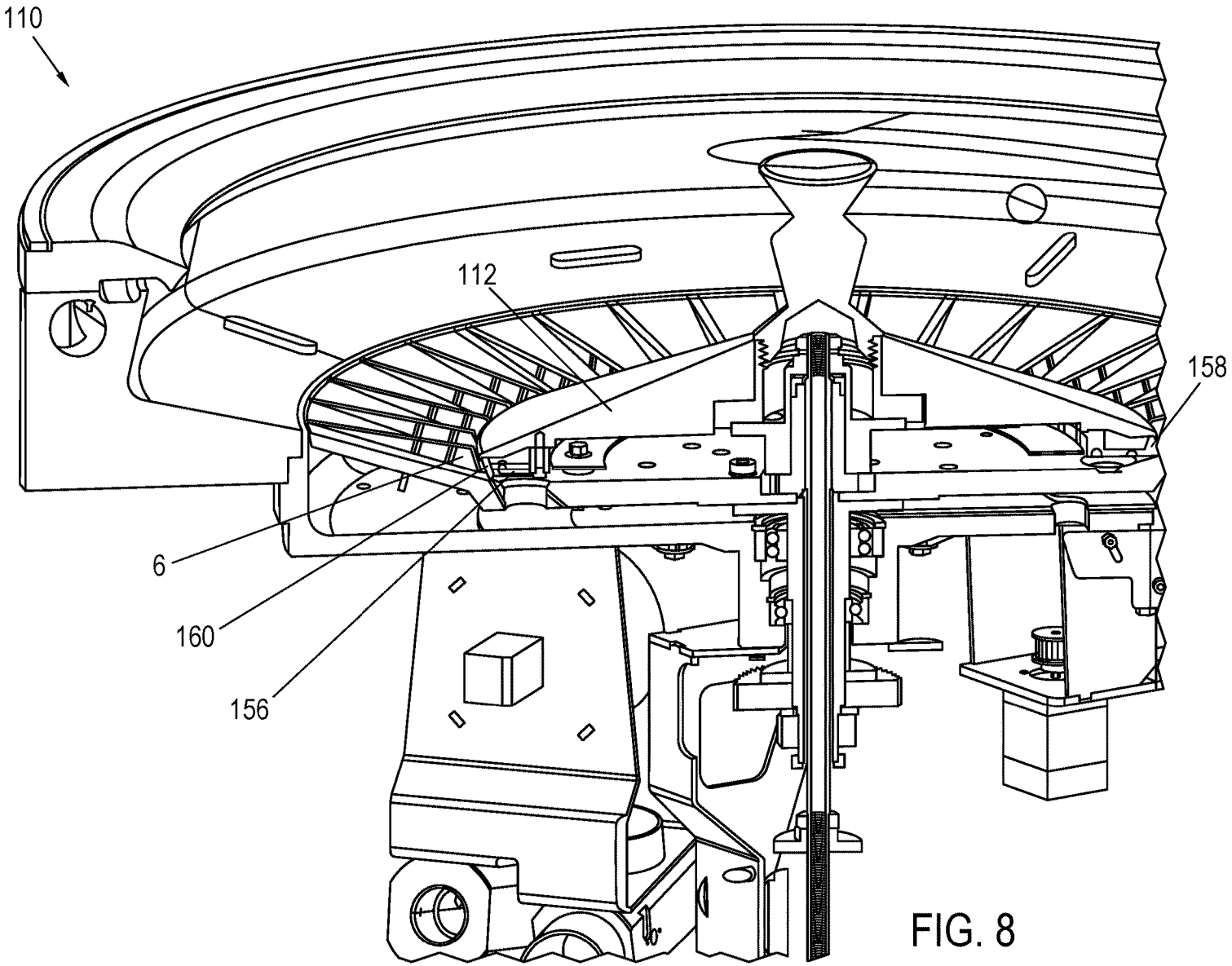
FIG. 8 is a schematic view illustrating the position of an illumination device that may be used with the roulette apparatus of FIG. 1.

In some embodiments, one or more illumination devices may be mounted in the center of the rotating wheel and positioned to direct illumination radially outward. For example, FIG. 8 illustrates an embodiment of a roulette apparatus 110 which includes a one or more illumination devices 156, such as LED lights, mounted in a radially outer periphery 158 of the central cone 112 adjacent to a pocket 6. Illumination devices 158 may illuminate during game play in one or more colors to present an appealing display, and in combination with a sensing device, illuminate the pocket 6 in which a ball 8 and/or 9 comes to rest. In this embodiment, a translucent panel 160 is mounted in central cone 112 at the radially outer periphery 158 which directs light from illumination devices 156 into a pocket 6.

The apparatus of the invention may also be combined with a live game that includes one or more remote kiosks or gaming stations. Each station is configured to receive and determine wagers based on one or more live games played at a nearby or remote location. The system is therefore configured to include devices which monitor the one or more live games, such as a roulette game presented within the current invention, in which a physical reel or other gaming elements are activated or employed, and collect the game play data from each of the games. In some embodiments, the game play data is manually entered for collection by the system. The game play data collected is transmitted to the terminals and used to determine the outcome of wagers placed at the terminals. The stations may be any apparatus or device capable of receiving and transmitting data, including devices which either process game play data or do not process game play data, including "thin-client" or "smart" devices. The stations present the live game information for each of the live games on a display device and further include a data input device for facilitating the entry of wagers. Thus, players interested in placing wagers on a live game are not confined to a single location or even the casino floor as the games continue.

It should be understood that each of the methods and individual steps recited herein may be partially or wholly carried out in a variety of ways and/or systems, which may include, but are not limited to, an electronic gaming machine (EGM) for use by one or more players, a multiplayer platform which may include a player interface such as a touchscreen display and involve physical or virtual game symbols, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve communications between computing components, indicating preferences, placing wagers, debiting and awarding credits stored in an account, the generation of random data and results for one or more players, the application of randomly-generated data to resolve wagers, the pooling of all wagers placed, the determination of wager outcomes in accordance with preset outcome determining criteria, and the notification of such outcomes along with the designation of a portion of the wager pool for each player and roulette game outcome. The generation of random data may be facilitated by computerized and/or physical implements, such as a random number generator. The transformative events may also include parsing of the data for comparative purposes with preset criteria to determine an outcome in the underlying roulette game.

Those skilled in the art will readily appreciate that any of the systems and methods of the invention may be constructed of any suitable materials.

It should be understood that any of the aforementioned embodiments of the invention may be incorporated in a fully or partially automated or interactive, computerized platform supporting multiple player positions and wagering and/or provided online. The apparatus may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. Those skilled in the art will further appreciate that the precise types of software and hardware used are not vital to the full implementation of the methods of the invention.

It should be readily apparent that additional computerized or manual systems may also be employed in accordance with the invention in order to achieve its full implementation as a system, apparatus or method.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

In some embodiments, a controller may include a processor, which as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The scope of the invention includes other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The gaming machine of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Those skilled in the art will readily appreciate that the apparatus described herein may include various computer and network related software and hardware, such as programs, operating systems, memory storage devices, data input/output devices, data processors, servers with links to data communication systems, wireless or otherwise, and data transceiving terminals. Those skilled in the art will further appreciate that the precise types of software and hardware used are not vital to the full implementation of the apparatus of the invention so long as it performs as described in at least one of the embodiments herein.

While exemplary apparatus, systems and methods of the invention have been described herein, and in the accompanying materials, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein and in the accompanying materials which disclose various exemplary embodiments of the invention, the claims, and any equivalents thereto.

The invention claimed is:

1. An automated roulette apparatus, the roulette apparatus including a roulette wheel mounted for rotational motion on a wheel base, the roulette wheel including a central cone and a plurality of pockets, the roulette apparatus comprising:

a ball router, the ball router having a conduit defined in an inner housing, the inner housing being mounted for rotational motion within an outer housing, the outer housing including a first outlet and a second outlet, the inner housing being configured to rotate to a first position aligning the conduit with the first outlet and a second position aligning the conduit with the second outlet, wherein the inner housing being in the first position defines a first roulette ball route through the conduit to the first outlet, and the inner housing being in the second position defines a second roulette ball route through the conduit to the second outlet, the inner housing further including an inner chamber with a door, the door to the inner chamber being configured to (i) move in an opened condition to enable access between the inner chamber and a position in the conduit in both the first roulette ball route and the second roulette ball route, and (ii) move in a closed condition to restrict access between the inner chamber and the conduit; and a controller configured to (i) direct the rotational motion of the inner housing and (ii) actuate the door to move from the closed condition to the opened condition responsive to a triggering event.

2. The roulette apparatus of claim 1, further comprising an apparatus for elevating the central cone from a seated position to an elevated position relative to the roulette wheel, wherein the elevated position of the central cone exposes a receiving space.

3. The roulette apparatus of claim 2, wherein the receiving space further comprises a chute connected with the conduit.

4. The roulette apparatus of claim 1, wherein the first outlet is connected with a first ball propelling device.

5. The roulette apparatus of claim 4, wherein the first ball propelling device is configured to propel a roulette ball through a tube, the tube having an outlet for directing the roulette ball in a first direction relative to the roulette wheel.

6. The roulette apparatus of claim 5, wherein the second outlet is connected with a second ball propelling device.

7. The roulette apparatus of claim 6, wherein the second ball propelling device is configured to propel a roulette ball through a tube, the tube having an outlet for directing the roulette ball in a second direction relative to the roulette wheel, wherein the first and second directions are opposing one another.

8. The roulette apparatus of claim 1, wherein the triggering event is a randomly generated outcome.

9. The roulette apparatus of claim 1, wherein a roulette ball is stored in the inner chamber, the roulette ball being released responsive to the door opening to enable access between the inner chamber and the conduit.

10. The roulette apparatus of claim 1, wherein the central cone further comprises a plurality of illumination devices, each illumination device of the plurality being mounted on a radially outer portion of the central cone.

11. An automated roulette apparatus, the roulette apparatus including a roulette wheel mounted for rotational motion on a wheel base, the roulette wheel including a central cone and a plurality of pockets, the roulette apparatus comprising:

a ball router, the ball router having a conduit defined in an inner housing, the inner housing being mounted for rotational motion within an outer housing, the outer housing including a first outlet and a second outlet, the inner housing being configured to rotate to a first position aligning the conduit with the first outlet and a second position aligning the conduit with the second outlet, whereby a roulette ball is routed by the ball router to the first outlet responsive to the inner housing being in the first position and the roulette ball is routed by the ball router to the second outlet responsive to the inner housing being in the second position, the inner housing further including an inner chamber with a door, the door being configured to move to (i) an open condition to enable access between the inner chamber and the conduit and (i) a closed position to restrict access between the inner chamber and the conduit, wherein the door in the opened condition and the door in the closed condition are independent of the roulette ball being routed by the ball router;

a motor configured to elevate the central cone from a seated position to an elevated position relative to the roulette wheel, wherein the elevated position of the central cone exposes a chute connected with the conduit; and a controller configured to (i) direct the rotational motion of the inner housing and (ii) actuate the door to the open condition responsive to a triggering event.

12. The roulette apparatus of claim 11, wherein the first outlet is connected with a first ball propelling device, the first ball propelling device comprising an air blower.

13. The roulette apparatus of claim 12, wherein the first ball propelling device is configured to propel a roulette ball through a tube, the tube having an outlet for directing the roulette ball in a first direction relative to the roulette wheel.

14. The roulette apparatus of claim 13, wherein the second outlet is connected with a second ball propelling device, the second ball propelling device comprising an air blower.

15. The roulette apparatus of claim 14, wherein the second ball propelling device is configured to propel a roulette ball through a tube, the tube having an outlet for directing the roulette ball in a second direction relative to the roulette wheel, wherein the first and second directions are opposing one another.

16. The roulette apparatus of claim 11, wherein the triggering event is a randomly generated outcome.

17. An automated roulette apparatus, the roulette apparatus including a roulette wheel mounted for rotational motion on a wheel base, the roulette wheel including a central cone and a plurality of pockets, the roulette apparatus comprising:

a ball router, the ball router having a conduit defined in an inner housing, the inner housing being mounted for rotational motion within an outer housing, the outer housing including a first outlet, the inner housing being configured to rotate to a first position aligning the conduit with the first outlet, whereby a first roulette ball route is defined by the inner housing being in the first position, the inner housing further including an inner chamber with a door configured to (i) open, wherein an opening of the door enables access between the inner chamber and the conduit and ii close, wherein a closing of the door restricts access between the inner chamber and the conduit, wherein the opening of the door and the closing of are independent of the first roulette ball route;

a motor configured to elevate the central cone from a seated position to an elevated position relative to the roulette wheel, wherein the elevated position of the central cone exposes a chute connected with the conduit;

a controller configured to (i) direct the rotational motion of the inner housing and (ii) actuate the door to open and close responsive to a triggering event; and a first ball propelling device comprising an air blower connected to the first outlet, wherein the first ball propelling device is configured to propel a roulette ball through a tube, the tube having an outlet for directing the roulette ball in a first direction relative to the roulette wheel.

18. The roulette apparatus of claim 17, further comprising the outer housing having a second outlet, wherein the inner housing is further configured to rotate to a second position aligning the conduit with the second outlet, the second outlet being connected with a second ball propelling device, the second ball propelling device comprising an air blower.

19. The roulette apparatus of claim 18, wherein the second ball propelling device is configured to propel a roulette ball through a tube, the tube having an outlet for directing the roulette ball in a second direction relative to the roulette wheel, wherein the first and second directions are opposing one another.

20. The roulette apparatus of claim 17, wherein the triggering event is a randomly generated outcome.

* * * * *